US010210810B1

(12) United States Patent
Wang et al.

(10) Patent No.: US 10,210,810 B1
(45) Date of Patent: Feb. 19, 2019

(54) OLED PIXEL DRIVING CIRCUIT, OLED DISPLAY PANEL, AND DRIVING METHOD

(71) Applicant: SHENZHEN CHINA STAR OPTOELECTRONICS SEMICONDUCTOR DISPLAY TECHNOLOGY CO., LTD., Shenzhen, Guangdong (CN)

(72) Inventors: Shan Wang, Guangdong (CN); Xiaolong Chen, Guangdong (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 15/741,865

(22) PCT Filed: Nov. 30, 2017

(86) PCT No.: PCT/CN2017/113722

§ 371 (c)(1),
(2) Date: Jan. 4, 2018

(30) Foreign Application Priority Data

Nov. 6, 2017 (CN) ..... 2017 1 1080230

(51) Int. Cl.
*G09G 3/3258* (2016.01)

(52) U.S. Cl.
CPC ... *G09G 3/3258* (2013.01); *G09G 2300/0819* (2013.01); *G09G 2310/08* (2013.01); *G09G 2320/0233* (2013.01); *G09G 2320/045* (2013.01)

(58) Field of Classification Search
CPC ..... G09G 3/3258; G09G 2320/0233; G09G 2310/08; G09G 2320/045; G09G 2300/0819
See application file for complete search history.

(56) References Cited

U.S. PATENT DOCUMENTS

2011/0109598 A1* 5/2011 Oh ..... G09G 3/3233 345/204
2015/0279277 A1* 10/2015 Xu ..... G09G 3/3233 345/690

FOREIGN PATENT DOCUMENTS

| | | |
|---|---|---|
| CN | 1601594 | 3/2005 |
| CN | 102789761 | 11/2012 |
| CN | 103198788 | 7/2013 |

(Continued)

*Primary Examiner* — Abhishek Sarma
(74) *Attorney, Agent, or Firm* — Hauptman Ham, LLP

(57) ABSTRACT

An OLED pixel driving circuit includes a first TFT having gate connected to a third node, and having a source and a drain connected to a second node and a first node respectively; a second TFT, having gate receiving a scan signal, and having a source and a drain connected to the first node and the third node respectively; a third TFT, having gate receiving the scan signal, and having a source and a drain connected to the second node and utilized for inputting a data voltage respectively; a fourth TFT, having gate receiving an illumination signal, and having a source and a drain connected to the second node and a DC high voltage power source respectively; a fifth TFT, having gate receiving the illumination signal, and having a source and a drain connected to the first node and an anode of an OLED, and two capacitors.

8 Claims, 4 Drawing Sheets

(56) References Cited

FOREIGN PATENT DOCUMENTS

| | | |
|---|---|---|
| CN | 104778915 | 7/2015 |
| CN | 105989805 | 10/2016 |

* cited by examiner

OLED PIXEL DRIVING CIRCUIT, OLED DISPLAY PANEL, AND DRIVING METHOD

RELATED APPLICATIONS

The present application is a National Phase of International Application Number PCT/CN2017/113722, filed on Nov. 30, 2017, and claims the priority of China Application Number 201711080230.3, filed on Nov. 6, 2017.

FIELD OF THE DISCLOSURE

The present invention is related to display technology, and more particularly is related to an OLED pixel driving circuit.

BACKGROUND

As a new generation display technology, organic light-emitting diode (OLED) panels have the advantages of low power consumption, high brightness, high resolution, wide viewing angle, high response speed, and etc., and thus are quite popular to the market.

Based on the driving methods, OLED displays can be sorted as the passive matrix OLED (PMOLED) display and the active matrix OLED (AMOLED) display. The AMOLED display features the active driving part to drive the pixels arranged in a matrix, has the advantage of high illumination efficiency, and thus is usually used as a large-scale display with high resolution.

FIG. 1 is a circuit diagram of a conventional OLED 2TIC pixel driving circuit. As shown, the technology of the conventional driving method and the pixel structure thereof is to apply different DC driving voltages to the OLED to have the OLED generates the needed color and brightness in different grayscales. 2T1C refers to the usage of two transistors and one capacitor, wherein the transistor T2 is the switching TFT, which is controlled by a scan signal Gate, and is utilized for controlling the entry of a data signal Data and acts as a switch to control charge/discharge of the capacitor Cst. The other transistor T1 is the driving TFT, which is utilized for driving the OLED by controlling the current passing through the OLED. The capacitor Cst is mainly utilized for storing the data signal Data so as to control the driving current applied to the OLED through the transistor T1. As an example, in the circuit diagram shown in FIG. 1, both the TFTs T1 and T2 are P-type TFTs, the scan signal Gate may come from a gate driver corresponding to a specific scan line, and the data signal Data may come from a source driver corresponding to a specific data line. OVDD is a high voltage power source, and OVSS is a low voltage power source.

After the scan signal Gate turns on the switch, the voltage Vdata of the data signal Data would be applied to the driving TFT T1 and stored in the capacitor Cst to have the transistor T1 stays in the on-state. Thus, the OLED would be continuingly placed in the DC-biased state and the internal ions would be polarized to form the internal electric field, which may result in the increasing of threshold voltage of the OLED and the brightness of the OLED would be steadily declined. The continuingly illumination would reduce the lifespan of the OLED. In addition, different degradation of the OLED pixels would result in display non-uniformity which may affect the display quality.

FIG. 2*a* is a circuit diagram of a conventional OLED 5TIC pixel driving circuit. FIG. 2*b* is a timing diagram of the circuitry shown in FIG. 2*a*. As shown, the circuit includes five thin-film transistors T1-T5 and one capacitor Cs. As an example, all the TFTs are N-type TFTs, and the input signals include a data voltage Vdata, a scan signal SCAN, an illumination signal EM, a DC high voltage VDD, and a DC low voltage VSS. According to the timing diagram, the driving process of the OLED is controlled by the scan signal SCAN (specified as S1 and Sn in the timing diagram to represent the scan signals of column 1 and column n), the illumination signal EM, and the DC high voltage VDD and is divided into two stages, i.e. data storing and threshold compensation stage and illumination stage. However, the conventional OLED 5T1C pixel driving circuit has the following drawbacks: the voltage level of VDD needs to be changeed, the rapidly changeing voltage level and the large level difference may result in the insufficient charge/discharge time and the current may get too high; the hardware for changing the voltage level of VDD is complicated, and the driving transistor should be a P-type transistor in order to eliminate voltage drift.

In conclusion, each of the aforementioned conventional OLED pixel driving circuits has the drawbacks need to be resolved. As shown in FIG. 1, the driving method of the conventional OLED 2T1C pixel driving circuit may result in degradation of the OLED easily because the voltage Vdata would be stored in the capacitor Cst to have the driving TFT stays in the on-state after the scan signal Gate turns on the pixel driving circuit so as to have the OLED continuingly placed in the DC-biased state. As shown in FIG. 2*a* and FIG. 2*b*, the conventional OLED 5T1C pixel driving circuit cannot be accomplished without the operations to eliminate the threshold voltage and to change the voltage level of VDD.

SUMMARY

Accordingly, it is a main object of the present invention to provide an OLED pixel driving circuit to eliminate the condition of illumination non-uniformity due to the variation of threshold voltage resulted from the non-uniformity of the fabrication process of the driving transistors.

It is another object of the present invention to provide an OLED display panel to eliminate the condition of illumination non-uniformity due to the variation of threshold voltage resulted from the non-uniformity of the fabrication process of the driving transistors.

It is still another object of the present invention to provide a driving method of an OLED pixel driving circuit to eliminate the condition of illumination non-uniformity due to the variation of threshold voltage resulted from the non-uniformity of the fabrication process of the driving transistors.

In order to achieve the aforementioned objects, an OLED pixel driving circuit is provided in the present invention. The OLED pixel driving circuit includes a first thin film transistor (TFT), having a gate electrode thereof connected to a third node, and having a source electrode and a drain electrode thereof connected to a second node and a first node respectively; a second TFT, having a gate electrode thereof receiving a scan signal, and having a source electrode and a drain electrode thereof connected to the first node and the third node respectively; a third TFT, having a gate electrode thereof receiving the scan signal, and having a source electrode and a drain electrode thereof connected to the second node and utilized for inputting a data voltage respectively; a fourth TFT, having a gate electrode thereof receiving an illumination signal, and having a source electrode and a drain electrode thereof connected to the second node and a DC high voltage power source respectively; a fifth TFT, having a gate electrode thereof receiving the illumination signal, and having a source electrode and a drain electrode thereof connected to the first node and an anode of an OLED, and the OLED having a cathode thereof connected to a DC low voltage power source; a first capacitor, having two ends connected to the second node and the third node respectively; and a second capacitor, having two ends connected to the third node and grounded respectively; wherein the first TFT is a P-type transistor, and the second TFT, the third TFT, the fourth TFT, and the fifth TFT are N-type transistors.

In accordance with an embodiment of the driving circuit of the present invention, a timing arrangement of the scan signal and the illumination signal includes a data storing and threshold compensation stage and an illumination stage.

In accordance with an embodiment of the driving circuit of the present invention, during the data storing and threshold compensation stage, the scan signal is at a high level, and the illumination signal is at a low level.

In accordance with an embodiment of the driving circuit of the present invention, during the illumination stage, the scan signal is at a low level, and the illumination signal is at a high level.

An OLED display panel is also provided in the present invention. The OLED display panel comprises the aforementioned OLED pixel driving circuit.

A driving method for the aforementioned OLED pixel driving circuit is also provided in the present invention. The driving method comprises arranging a timing of the scan signal and the illumination signal to include a data storing and threshold compensation stage and an illumination stage.

In accordance with an embodiment of the driving method of the present invention, during the data storing and threshold compensation stage, the scan signal is at a high level, and the illumination signal is at a low level.

In accordance with an embodiment of the driving method of the present invention, during the illumination stage, the scan signal is at a low level, and the illumination signal is at a high level.

In conclusion, the OLED pixel driving circuit, the OLED display panel, and the driving method thereof provided in accordance with the present invention are capable to eliminate the condition of illumination non-uniformity due to the variation of threshold voltage resulted from the non-uniformity of the fabrication process of the driving transistors such that the display quality of the panel can be enhanced.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

Figure 1:
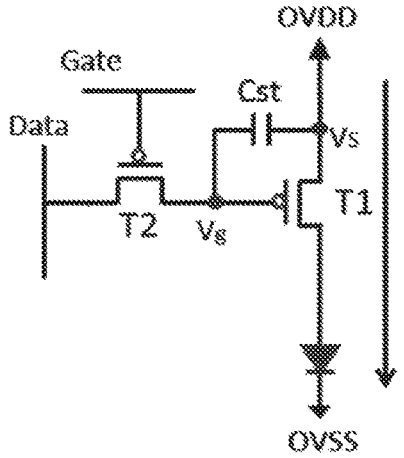
FIG. 1 is a circuit diagram of a conventional OLED 2T1C pixel driving circuit.
Figure 2A:
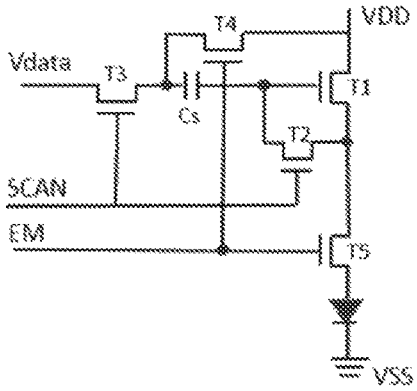
FIG. 2*a* is a circuit diagram of a conventional OLED 5T1C pixel driving circuit.
Figure 2B:
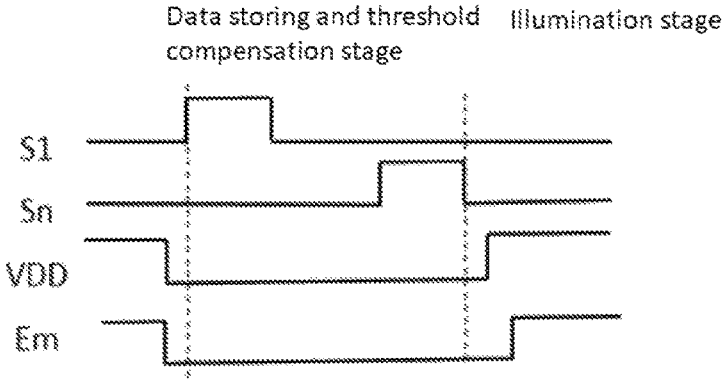
FIG. 2*b* is a timing diagram of the circuitry shown in FIG. 2*a;*
Figure 3:
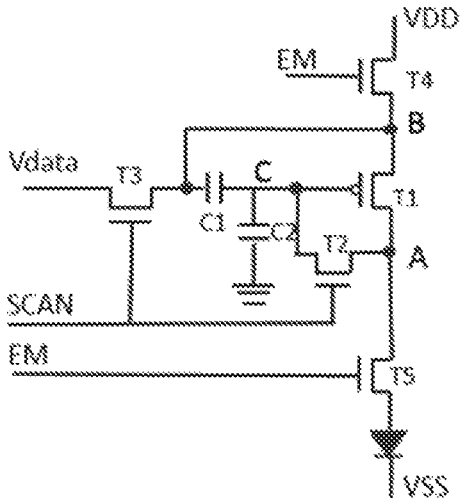
FIG. 3 is a circuit diagram of the OLED pixel driving circuit in accordance with a preferred embodiment of the present invention.
Figure 4:
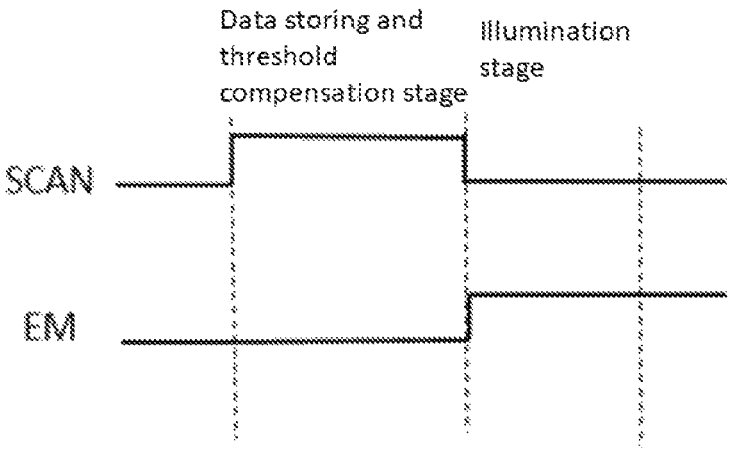
FIG. 4 is a timing diagram of the circuitry shown in FIG. 3.

Please refer to FIG. 3 and FIG. 4, wherein FIG. 3 is a circuit diagram of the OLED pixel driving circuit in accordance with a preferred embodiment of the present invention, and FIG. 4 is a timing diagram of the circuitry shown in FIG. 3. As shown, an OLED 5T2C pixel driving circuit is provided in the present invention for driving the OLED. In accordance with the preferred embodiment, the circuit mainly includes:

a TFT T1, having a gate electrode thereof connected to node C, and having a source electrode and a drain electrode thereof connected to node B and node A respectively; a TFT T2, having a gate electrode thereof receiving a scan signal Scan, and having a source electrode and a drain electrode thereof connected to node A and anode C respectively; a TFT T3, having a gate electrode thereof receiving the scan signal Scan, and having a source electrode and a drain electrode thereof connected to node and utilized for inputting a data voltage Vdata respectively; a TFT T4, having a gate electrode thereof receiving an illumination signal EM, and having a source electrode and a drain electrode thereof connected to node B and a DC high voltage power source VDD respectively; a TFT T5, having a gate electrode thereof receiving the illumination signal EM, and having a source electrode and a drain electrode thereof connected to node A and an anode of an OLED, and the OLED having a cathode thereof connected to a DC low voltage power source VSS; a first capacitor C1, having two ends connected to node B and node C respectively; and a second capacitor C2, having two ends connected to node C and grounded respectively.

In the present embodiment, the TFT T1 is a P-type transistor, and the TFTs T2-T5 are N-type transistors.

The timing arrangement of the scan signal Scan and the illumination signal EM is arranged to include a data storing and threshold compensation stage and an illumination stage, which correspond to the two stages of the driving process respectively, which are the first stage, i.e. OLED data voltage Vdata storing and threshold compensation stage, and the second stage, i.e. OLED illumination stage.

Figure 5A:
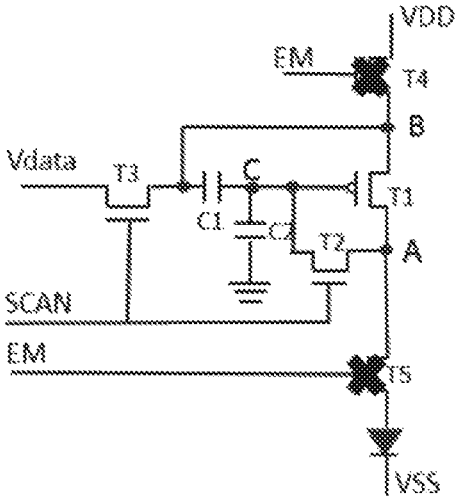
FIG. 5*a* is a schematic view showing the condition of the circuitry of FIG. 3 during the data storing and threshold compensation stage.
Figure 5B:
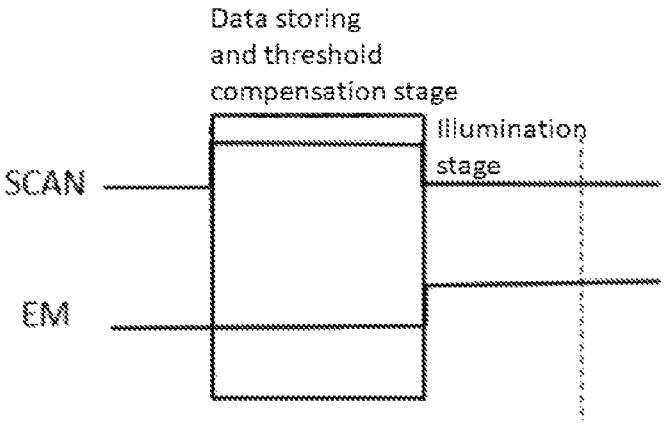
FIG. 5*b* is a timing diagram showing the driving signal of the circuitry of FIG. 3 during the data storing and threshold compensation stage.

Please refer to FIG. 5*a* and FIG. 5*b*, wherein FIG. 5*a* is a schematic view showing the condition of the circuitry of FIG. 3 during the data storing and threshold compensation stage, and FIG. 5*b* is a timing diagram of the corresponding circuit driving signals.

In the first stage, i.e. OLED data voltage Vdata storing and threshold compensation stage, the scan signal Scan is at a high level, and the illumination signal EM is at a low level.

Because the scan signal Scan is at the high level, and the illumination signal is at the low level, the TFTs T2 and T3 would be conducted, and the TFTs T4 and T5 would be turned off, and the voltage level VB of node B equals to Vdata and is charged through the TFT T1 until the TFT T1 is cut off. Thus, the voltage level VC of node C can be represented as VC=Vdata−Vth, wherein Vth is the cutoff voltage of the TFT T1.

The storing process of the OLED data voltage Vdata and the compensation to the threshold voltage of TFT is completed in this stage.

Figure 6A:
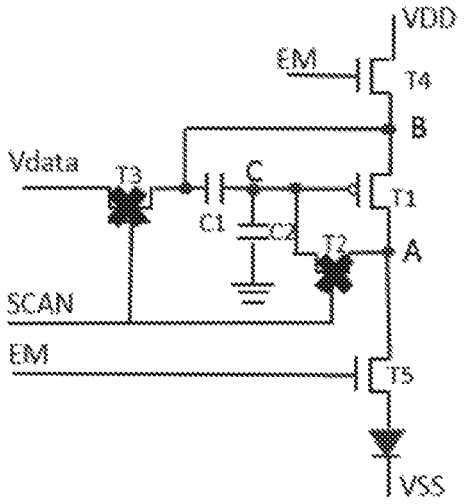
FIG. 6*a* is a schematic view showing the condition of the circuitry of FIG. 3 during the illumination stage.
Figure 6B:
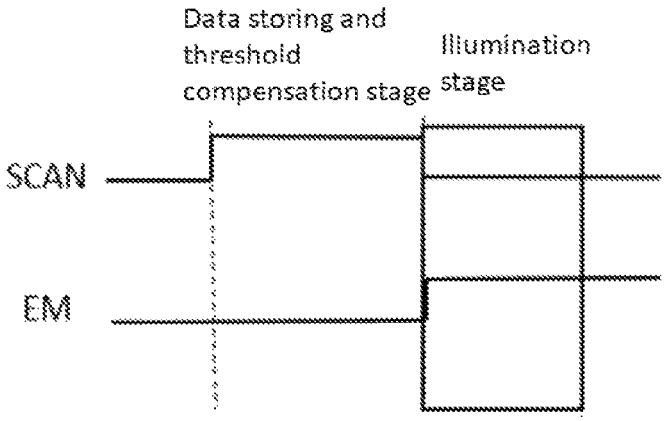
FIG. 6*b* is a timing diagram showing the driving signal of the circuitry of FIG. 3 during the illumination stage.

Please refer to FIG. 6*a* and FIG. 6*b*, wherein FIG. 6*a* is a schematic view showing the condition of the circuitry of FIG. 3 during the illumination stage, and FIG. 6*b* is a timing diagram of the corresponding circuit driving signals.

In the second stage, i.e. the OLED illumination stage, the scan signal Scan is at a low level, and the illumination signal EM is at a high level.

Because the scan signal Scan is at the low level and the illumination signal is at the high level, the TFTs T2 and T3 would be turned off, and the TFTs T4 and T5 would be conducted, and the voltage level at node B would be changed from the original Vdata to VDD. Because the voltage difference of the capacitor C1 stays constant, the voltage level of node C would be also changed. The change value is $\Delta V=(VDD-Vdata)\times C1/(C1+C2)$, and the voltage level at node C can be represented as $VC=Vdata-Vth+\Delta V=Vg$, and $Vs=VB=VDD$. Because the data voltage Vdata is stored in the capacitor C1, the OLED would illuminate.

At this time, the driving current Ioled can be represented as $Ioled=k(Vsg-Vth)^2=k(VDD-(Vdata-Vth+\Delta V)-Vth)^2=k[(VDD-Vdata)\times C2/(C1+C2)]^2$, and thus the condition of illumination non-uniformity due to the variation of threshold voltage resulted from the non-uniformity of the fabrication process of the driving transistors can be eliminated so as to have the OLED illuminates.

The illumination of the OLED is completed in this stage.

The OLED pixel driving circuit provided in the present invention uses the N-type and the P-type TFTs to reduce the number of control signal lines needed for the driving process and have the driving process defined as two stages, such that the design of the timing controller (TCON) can be simpler. In addition, it is not necessary to change the voltage level of VDD by using the OLED pixel driving circuit of the present invention such that the damage of large current and high voltage can be prevented, and the pixel driving circuit also eliminates the threshold voltage of the driving transistor such that the display panel may have an uniform illumination and the display quality can be enhanced.

In conclusion, the OLED pixel driving circuit, the OLED display panel, and the driving method thereof provided in accordance with the present invention are capable to eliminate the condition of illumination non-uniformity due to the variation of threshold voltage resulted from the non-uniformity of the fabrication process of the driving transistors such that the display quality of the panel can be enhanced.

The foregoing contents are detailed description of the disclosure in conjunction with specific preferred embodiments and concrete embodiments of the disclosure are not limited to the description. For the person skilled in the art of the disclosure, without departing from the concept of the disclosure, simple deductions or substitutions can be made and should be included in the protection scope of the application.

What is claimed is:

1. An OLED pixel driving circuit, comprising:

a first thin film transistor (TFT), having a gate electrode thereof connected to a third node, and having a source electrode and a drain electrode thereof connected to a second node and a first node respectively;

a second TFT, having a gate electrode thereof receiving a scan signal, and having a source electrode and a drain electrode thereof connected to the first node and a third node respectively;

a third TFT, having a gate electrode thereof receiving the scan signal, and having a source electrode and a drain electrode thereof connected to the second node and utilized for inputting a data voltage respectively;

a fourth TFT, having a gate electrode thereof receiving an illumination signal, and having a source electrode and a drain electrode thereof connected to the second node and a DC high voltage power source respectively;

a fifth TFT, having a gate electrode thereof receiving the illumination signal, and having a source electrode and a drain electrode thereof connected to the first node and an anode of an OLED, and the OLED having a cathode thereof connected to a DC low voltage power source;

a first capacitor, having two ends connected to the second node and the third node respectively; and a second capacitor, having two ends connected to the third node and grounded respectively;

wherein the first TFT is a P-type transistor, and the second TFT, the third TFT, the fourth TFT, and the fifth TFT are N-type transistors.

2. The OLED pixel driving circuit of claim 1, wherein a timing arrangement of the scan signal and the illumination signal includes a data storing and threshold compensation stage and an illumination stage.

3. The OLED pixel driving circuit of claim 2, wherein during the data storing and threshold compensation stage, the scan signal is at a high level, and the illumination signal is at a low level.

4. The OLED pixel driving circuit of claim 2, wherein during the illumination stage, the scan signal is at a low level, and the illumination signal is at a high level.

5. An OLED display panel, comprising the OLED pixel driving circuit of claim 1.

6. A driving method for the OLED pixel driving circuit of claim 1, comprising: arranging a timing of the scan signal and the illumination signal to include a data storing and threshold compensation stage and an illumination stage.

7. The driving method of claim 6, wherein during the data storing and threshold compensation stage, the scan signal is at a high level, and the illumination signal is at a low level.

8. The driving method of claim 6, wherein during the illumination stage, the scan signal is at a low level, and the illumination signal is at a high level.

* * * * *